United States Patent [19]

Namiki et al.

[11] Patent Number: 4,946,645

[45] Date of Patent: Aug. 7, 1990

[54] STEEL FOR GEARS, HAVING HIGH STRENGTH, TOUGHNESS AND MACHINABILITY

[75] Inventors: Kunio Namiki, Nagoya; Atsuyoshi Kumura, Kuwana; Sukehisa Niwa, Tokorozawa; Toshihiko Matsubara, Kawagoe, all of Japan

[73] Assignees: Daido Tokushuko Kabushiki Kaisha; Honda Giken Kogyo Kabushiki Kaishya, both of Japan

[21] Appl. No.: 329,822

[22] Filed: Mar. 28, 1989

[30] Foreign Application Priority Data

Mar. 28, 1988 [JP] Japan ..... 63-74199

[51] Int. Cl.[5] ..... C22C 38/00

[52] U.S. Cl. ..... 420/84; 420/104; 148/333

[58] Field of Search ..... 420/84, 104; 148/333, 148/906; 29/132

[56] References Cited

FOREIGN PATENT DOCUMENTS

| | | | |
|---|---|---|---|
| 57-9860 | 1/1982 | Japan | 420/84 |
| 57-19365 | 2/1982 | Japan | 420/84 |
| 60-20359 | 2/1985 | Japan . | |
| 60-243252 | 12/1985 | Japan . | |

*Primary Examiner*—Deborah Yee

*Attorney, Agent, or Firm*—Arnold, White & Durkee

[57] ABSTRACT

A steel composition for gears, consisting of: 0.10-0.30% by weight of C; less than 0.15% by weight of Si; no more than 1.5% by weight of Mn; no more than 0.015% by weight of P; no more than 0.005% by weight of S; 0.50-1.50% by weight of Cr; 0.005-0.06% by weight of Pb; and the balance being Fe and inevitably included impurities.

6 Claims, No Drawings

STEEL FOR GEARS, HAVING HIGH STRENGTH, TOUGHNESS AND MACHINABILITY

BACKGROUND OF THE INVENTION

1. Field of the Invention

The present invention relates to an improved steel used for producing gears, and more particularly to improvements of such a steel, in machinability as well as strength and toughness.

2. Discussion of the Prior Art

Many types of gears have been used for various machines, devices, units and other equipment for transmitting power or motions. Automotive vehicles as transportation vehicles, for example, use a number of gears in steering and transmission systems, differential units and other devices. Improvements in properties of such gears have been increasingly desired, keeping up with a recent growing need for enhancing the quality and capability of the various machines, devices and units. In the fields of manufacture of automotive vehicles, it is desired to further improve the mechanical strength of the gears and other power transmission components, in an attempt to satisfy increasing requirements for enhanced performance, increased horsepower and reduced weight. There is a similar tendency in connection with steels for many mechanical structures.

In view of the industrial tendency indicated above, one of the applicants of the present application and other co-inventors proposed improved steels which make it possible to produce gears having high degrees of strength, toughness and reliability, as disclosed in laid-open Publications 60-21359 and 60-243252 of unexamined Japanese Patent Applications 58-128787 and 59-96600. Each of the proposed gear steels includes suitable amounts of C, Mn, S, Cr, Al, N, Si and P, and further includes specified amounts of Ni and Mo. These gear steels were confirmed to have advantages over the known steel materials such as SCr 420, SCM 420 and SNCM 420 (according to the Japanese Industrial Standard). In the high-strength steels proposed in the above two Publications, up to 0.030% or 0.020% of sulfur (S) is included, as an element for effectively improving the machinability of the steels.

Gears are generally formed such that stresses at the root of the teeth are exerted in a direction perpendicular to the direction in which materials for the blanks or workpieces of the gears are rolled. If the steel for a gear contains a certain amount of sulfur (S) for improving the machinability, as indicated above, sulfides or other substances exist extending in the rolling direction of the material, causing the material to be comparatively easily subjected to fatigue and impact destruction.

SUMMARY OF THE INVENTION

It is, therefore, an object of the present invention to provide a steel for gears which has improved strength and toughness while exhibiting enhanced machinability.

The above object may be accomplished according to one aspect of the present invention, which provides a steel for gears, consisting of: 0.10–0.30% by weight of C (carbon); less than 0.15% by weight of Si (silicon); no more than 1.5% by weight of Mn (manganese); no more than 0.015% by weight of P (phosphorus); no more than 0.005% by weight of S (sulfur); 0.50–1.50% by weight of Cr (chromium); 0.005–0.06% by weight of Pb (lead); and the balance being Fe (iron) and inevitably included impurities.

The above object may also be accomplished according to another aspect of the present invention, which provides a steel for gears, consisting of: 0.10–0.30% by weight of C (carbon); less than 0.15% by weight of Si (silicon); no more than 1.5% by weight of Mn (manganese); no more than 0.015% by weight of P (phosphorus); no more than 0.005% by weight of S (sulfur); 0.50–1.50% by weight of Cr (chromium); 0.005–0.06% by weight of Pb (lead); no more than 1.5% by weight of Ni (nickel) and/or no more than 0.5% by weight of Mo (molybdenum); and the balance being Fe (iron) and inevitably included impurities. The inclusion of Ni and/or Mo results in a significant increase in the toughness of a gear produced from the relevant steel, where the gear is carburized.

The functions of the components of the steel composition according to the instant invention, and the reasons for determining the limits of the components, are described below. The percentage values given below are based on the weights of the components.

C: 0.10–0.30%

This element is essential to assure the required core strength of a gear. For this purpose, the element should be included in an amount of at least 0.10%. The inclusion of the element in an amount exceeding 0.30% results in lowering the toughness of the gear, as well as reducing the compressive residual stress which is contributory to the strength of the gear. Thus, the content of carbon should not exceed 0.30%.

Si: less than 0.15%

The element Si contributes to strengthening the matrix of the steel. If the content is excessive, the portion of the carburized layer of the gear adjacent to its surface tends to be easily subjected to grain boundary oxidation, or the carburized layer tends to become abnormal, whereby the oxidized or abnormal carburized portion may initiate fatigue or impact destruction of the gear. For holding the grain boundary oxidation below a permissible level, the content of silicon should be less than 0.15%, preferably less than 0.10%, more preferably less than 0.05%.

Mn: no more than 1.5%

Mn improves hardenability of the steel. An optimum content of this element is determined in relation to the contents of the other components, in particular, Cr, Ni and Mo. Mn also serves to promote the grain boundary oxidation of the gear. For holding the oxidation below the permissible level, the content of Mn should not exceed 1.5%.

P: no more than 0.015%

The element P has a tendency of being segregated at the grain boundary during austenitization of the steel, resulting in an increase in the brittleness at the grain boundary. This tendency is eminent for the carburized layer (portion having a high content of carbon) of the steel. In this respect, it is required to minimize the content of P as much as practical, namely, down to 0.015% according to the invention, preferably down to 0.01%.

S: no more than 0.005%

This element cooperates with Mn to form a non-metallic compound (MnS), which extends in the rolling direction of the steel and which, therefore, deteriorates the toughness and ductility in the direction perpendicular to the rolling direction, i.e., in the direction in which stresses are exerted on the root of the teeth of the gear. For this reason, the content of S should be lowered as much as is practical. Namely, the content should not exceed 0.005%. In view of the comparatively low upper limit of sulfur, CaO, fluorite or light-burned dolomite is generally used as an agent for removing the sulfur (desulfurization). Since the removal of the sulfur by using an ordinary electric furnace takes a long time, it is required that a laddle furnace (LF) or a vacuum laddle furnance (VLF) be used for removing the sulfur from the molten steel.

Cr: 0.50–1.50%

Cr is an element which improves the hardenability of the steel. An optimum content of Cr should be determined in relation to the contents of the other elements. For obtaining the required strength at the core of the gear, the Cr content should be at least 0.5%. However, the Cr content should not exceed 1.50%, since the element increases the tendency of grain boundary oxidation of the steel.

Pb: 0.005–0.06%

The element Pb is added for the purpose of compensating for a decrease in machinability of the steel which results from the lowering of the content of S down to 0.005%. The element is not effective for improving the machinability if its content is less than 0.005%. When the Pb content exceeds 0.06%, the characteristics of the steel associated with the fatigue, in particular, rolling fatigue are deteriorated. Thus, the content of Pb should be held within a range of 0.005–0.06%.

Ni: no more than 1.5%

Mo: no more than 0.5%

These elements Ni and Mo are added to increase the toughness of the steel a carburized. Since these elements improve the hardenability of the steel and the addition of Ni and Mo in an excessive amount will cause the normalized steel to become a Bainite structure, thereby resulting in reducing the machinability. In this respect, the upper limits of the elements Ni and Mo are determined to be 1.5% and 0.5%, respectively.

The gear steel having the composition as described above is prepared in an ordinary process, and the prepared steel is suitable for producing various gears. The gears may be formed by the known techniques such as forging, press-forming and machining, and the formed gears may be hardened by suitable heat treatments or carburizing methods. Since the steel according to the present invention has improved machinability, the gears can be easily formed by machining operations. The machined or otherwise formed gears provide sufficiently high degrees of toughness and strength.

While the steel according to the principle of the present invention is suitably used for producing gears for automotive transmissions, it will be understood that the instant steel may be used for gears other than the transmission gears.

EXAMPLES

Some examples of the present invention will be described for illustrating purpose only. However, it is to be understood that the invention is not limited to the precise details of the illustrated examples, but may be embodied with various changes, modifications and improvements, which may occur to those skilled in the art, without departing from the spirit and scope of the invention.

TABLE 1

| No. | | CONTENTS OF COMPONENTS (% by weight) | | | | | | | | |
|---|---|---|---|---|---|---|---|---|---|---|
| | | C | Si | Mn | P | S | Ni | Cr | Mo | Pb |
| 1 | Invention | 0.15 | 0.04 | 1.08 | 0.005 | 0.002 | — | 0.98 | — | 0.03 |
| 2 | (I) | 0.21 | 0.05 | 0.82 | 0.008 | 0.003 | — | 1.04 | — | 0.05 |
| 3 | | 0.24 | 0.11 | 0.34 | 0.004 | 0.001 | — | 1.50 | — | 0.04 |
| 4 | Comparative | 0.20 | 0.06 | 0.85 | 0.006 | 0.002 | — | 1.10 | — | — |
| 5 | (I) | 0.19 | 0.05 | 0.80 | 0.005 | 0.003 | — | 1.07 | — | 0.08 |
| 6 | Invention | 0.26 | 0.02 | 0.73 | 0.003 | 0.004 | 0.48 | 0.94 | 0.28 | 0.02 |
| 7 | (II) | 0.18 | 0.04 | 1.18 | 0.010 | 0.002 | 0.85 | 0.66 | 0.42 | 0.04 |
| 8 | | 0.17 | 0.09 | 0.89 | 0.005 | 0.001 | — | 0.95 | 0.18 | 0.03 |
| 9 | Comparative | 0.21 | 0.26 | 0.85 | 0.015 | 0.016 | — | 1.01 | — | — |
| 10 | (II) | 0.20 | 0.24 | 0.54 | 0.018 | 0.015 | 1.76 | 0.53 | 0.21 | — |

Examples 1–3 and 6–8 were prepared according to the present invention, while Comparative Examples 4, 5, 9 and 10 were prepared for comparison. The compositions of the prepared steels are indicated in Table 1. Comparative Examples 9 and 10 are equivalent to ordinary steels SCr 420 and SNCM 420 (according to the Japanese Industrial Standard), respectively.

Cast ingots of the prepared steels having the different compositions as indicated were subjected to a blooming or cogging operation, and the obtained blooms were rolled into round rods having a diameter of 90 mm. The rods were normalized, and were processed into test specimens corresponding to the Examples. The test specimens were carburized, and held at 830° C. for 30 minutes. The specimens were then oil-cooled, and tempered at 180° C. for two hours.

The test specimens prepared as described above were subjected to a rolling test (b) and a machining test (c) as indicated below, and the corresponding test pieces of gears were subjected to a test (a) on a gear tester, as also indicated below.

(a) Gear Test

Two mating gears which have a pitch circle diameter of 70mm, and respective modules of 2.5 and 2.8 (with 28 and 25 teeth, respectively) were prepared for each of the Examples 1–10. The gears meshing with each other were operated on a gear tester, with the gear having the 28 teeth rotated at 3500 r.p.m., such that stresses were intermittently applied to the gears. The number of repetition of the stress application was $10^7$. The hardness values of the core of the tested gears and the fatigue limits of the gears were measured. The measurements are indicated in Table 2.

TABLE 2

| No. | GEAR TEST | | ROLLING TEST | |
|---|---|---|---|---|
| | Hardness (Hv) | Fatigue Limit ($kgf/mm^2$) | Hardness (Hv) | Rolling Life (B10) $\times 10^6$ |
| 1 | 375 | 70 | 371 | 11.4 |
| 2 | 392 | 72 | 403 | 11.0 |
| 3 | 405 | 72 | 408 | 18.8 |
| 4 | 386 | 70 | 397 | 25.3 |
| 5 | 390 | 71 | 402 | 7.0 |
| 6 | 437 | 75 | 445 | 18.5 |
| 7 | 403 | 77 | 399 | 15.8 |
| 8 | 394 | 72 | 405 | 15.2 |

TABLE 2-continued

| No. | GEAR TEST Hardness (Hv) | GEAR TEST Fatigue Limit ($kgf/mm^2$) | ROLLING TEST Hardness (Hv) | ROLLING TEST Rolling Life (B10) $\times 10^6$ |
|---|---|---|---|---|
| 9 | 389 | 60 | 392 | 7.4 |
| 10 | 402 | 65 | 400 | 8.9 |

(b) Rolling Test

Test pieces in the form of a rod having a diameter of 12mm and a length of 22mm were prepared from the individual specimens, and were subjected to a rolling test on a cylindrical rolling tester, with a surface pressure of $600kgf/mm^2$, at 462400 r.p.m. The rolling life ($B^{10}$) and the core hardness of the test pieces were measured. The measurements are also indicated in Table 2.

(c) Machining Test

Test pieces were subjected to a drilling test, wherein a hole was cut to a depth of 20mm, without a coolant, by a drill made of SKH 51 (according to the Japanese Industrial Standard) and having a diameter of 5mm. The machinability of the test pieces was evaluated by the cutting speed (m/min.) of the drill which provided a predetermined length of cutting life of the drill (2000mm =20mm×100 holes). The cutting speeds for the test pieces are indicated in Table 3.

TABLE 3

| No. | Machinability Expressed by Cutting Speed (m/min.) to Obtain 2000 mm Tool Life |
|---|---|
| 1 | 35 |
| 2 | 40 |
| 3 | 38 |
| 4 | 20 |
| 5 | 55 |
| 6 | 35 |
| 7 | 37 |
| 8 | 41 |
| 9 | 29 |
| 10 | 26 |

It will be understood from Table 2 that the steels of Examples 1–3 and 6–8 which include Si, P and S in comparatively reduced amounts according to the present invention exhibited comparatively high values of the fatigue limits, than the ordinary steels of Comparative Examples 4, 5, 9 and 10, in particular, Comparative Examples 9 and 10. This means improved strength and toughness of the steels according to the invention. It will also be understood that the instant steels have higher values of rolling life than the ordinary steels. However, it was found that an excessive amount of Pb caused a decrease in the rolling life. More specifically, Table 2 shows significant influences of Pb on the rolling life of Examples 2, 4 and 5. That is, the addition of Pb in an amount of 0.08% will shorten the rolling life.

It will also be understood from Table 3 that the steels according to the present invention have higher levels of machinability than the ordinary JIS steels (according to the Japanese Industrial Standard), and can be machined at higher cutting speeds.

As is apparent from the foregoing description, the gear steels according to the present invention not only provide improved machinability, but also assure increased strength and toughness of the gears prepared therefrom, making it possible to considerably reduce the value of module of the gears. Accordingly, the present invention can satisfy the requirements in the industries concerned, for lowering the operating noise level of the gears and reducing the size and weight of the gears.

What is claimed is:

1. A steel composition for gears, consisting of: 0 10–0.30% by weight of C; less than 0.15% by weight of Si; no more than 1.5% by weight of Mn; no more than 0.015% by weight of P; no more than 0.005% by weight of S; 0.50–1.50% by weight of Cr; 0.005–0.06% by weight of Pb; and the balance being Fe and inevitably included impurities.

2. A steel composition for gears, consisting of: 0.10–0.30% by weight of C; less than 0.15% by weight of Si; no more than 1.5% by weight of Mn; no more than 0.015% by weight of P; no more than 0.005% by weight of S; 0.50–1.50% by weight of Cr; 0.005–0.06% by weight Pb; no more than 1.5% by weight of Ni and/or no more than 0.5% by weight of Mo; and the balance being Fe and inevitably included impurities.

3. A gear of a steel consisting of: 0.10–0.30% by weight of C; less than 0.15% by weight of Si; no more than 1.5% by weight of Mn; no more than 0.015% by weight of P; no more than 0.005% by weight of S; 0.50–1.50% by weight of Cr; 0.005–0.06% by weight of Pb; and the balance being Fe and inevitably included impurities.

4. The gear of claim 3, said gear being used for an automotive transmission.

5. A gear of a steel consisting of: 0.10–0.30% by weight of C; less than 0.15% by weight of Si; no more than 1.5% by weight of Mn; no more than 0.015% by weight of P; no more than 0.005% by weight of S; 0.50–1.50% by weight of Cr; 0.005–0.06% by weight of Pb; no more than 1.5% by weight of Ni and/or no more than 0.5% by weight of Mo; and the balance being Fe and inevitably included impurities.

6. The gear of claim 5, said gear being used for an automotive transmission.

* * * * *